US005850053A

United States Patent [19]

Scheffee et al.

[11] Patent Number: 5,850,053

[45] Date of Patent: Dec. 15, 1998

[54] EUTECTIC MIXTURES OF AMMONIUM NITRATE, GUANIDINE NITRATE AND POTASSIUM PERCHLORATE

[75] Inventors: Robert S. Scheffee, Lorton; Brian K. Wheatley, Marshall, both of Va.

[73] Assignee: Atlantic Research Corporation, Wilmington, Del.

[21] Appl. No.: 663,012

[22] Filed: Jun. 7, 1996

Related U.S. Application Data

[63] Continuation-in-part of Ser. No. 508,350, Jul. 28, 1995, Pat. No. 5,726,382, which is a continuation-in-part of Ser. No. 414,470, Mar. 31, 1995, abandoned.

[51] Int. Cl.[6] ..... C06B 45/10

[52] U.S. Cl. ..... 149/19.91; 149/36; 149/47; 60/219; 280/741

[58] Field of Search ..... 149/47, 19.91, 149/36; 60/205, 219; 280/741

[56] References Cited

U.S. PATENT DOCUMENTS

| | | | |
|---|---|---|---|
| 3,031,347 | 4/1962 | Philipson . | |
| 3,739,574 | 6/1973 | Godfrey . | |
| 3,845,970 | 11/1974 | Herrmann . | |
| 3,909,324 | 9/1975 | Niles . | |
| 3,954,528 | 5/1976 | Chang et al. . | |
| 4,111,728 | 9/1978 | Ramnarace . | |
| 4,543,136 | 9/1985 | Edamura et al. . | |
| 4,948,439 | 8/1990 | Poole et al. . | |
| 5,035,757 | 7/1991 | Poole . | |
| 5,125,684 | 6/1992 | Cartwright . | |
| 5,197,758 | 3/1993 | Lund et al. . | |
| 5,336,439 | 8/1994 | Forsberg et al. . | |
| 5,411,615 | 5/1995 | Sumrail et al. . | |
| 5,431,103 | 7/1995 | Hock et al. | 102/287 |
| 5,482,579 | 1/1996 | Ochi et al. . | |
| 5,507,891 | 4/1996 | Zeigler | 149/47 |
| 5,545,272 | 8/1996 | Poole et al. | 149/48 |
| 5,551,725 | 9/1996 | Ludwig et al. | 280/741 |

*Primary Examiner*—Edward A. Miller
*Attorney, Agent, or Firm*—Lowe, Price, LeBlanc & Becker

[57] ABSTRACT

A eutectic solution of ammonium nitrate and either aminoguanidine nitrate (AGN) or guanidine nitrate (AN) in the form of a pressed pellet is used to generate a low particulate non-toxic, odorless and colorless gas that is useful wherever an immediate source of such gas is required, such as the inflation of an occupant restraint air bag. The use of the material in the form of a eutectic totally eliminates pellet cracking. Moreover, the addition of a minor amount of potassium perchlorate to the eutectic solution improves stability at 107° for 400 hours, lowers the pressure exponent and increases the burn rate at 2000 psi.

19 Claims, 3 Drawing Sheets

EUTECTIC MIXTURES OF AMMONIUM NITRATE, GUANIDINE NITRATE AND POTASSIUM PERCHLORATE

This application is a continuation-in-part of application Ser. No. 08/508,350, filed Jul. 28, 1995 and now U.S. Pat. No. 5,726,382, which is in turn a continuation-in-part of application Ser. No. 08/414,470, filed Mar. 31, 1995, now abandoned.

FIELD OF THE INVENTION

The present invention relates to a eutectic solution-forming mixture of ammonium nitrate (AN) and either aminoguanidine nitrate (AGN) or guanidine nitrate (GN) and potassium perchlorate ($KClO_4$) that will generate a low particulate non-toxic, odorless and colorless gas, for various purposes, such as inflating a vehicle occupant restraint, i.e., an air bag for an automotive vehicle.

PRIOR ART

The present invention relates generally to solid composite propellant compositions and more particularly to solid composite propellant compositions useful as gas generators.

Recently, there has been a great demand for new gas generating propellants which are cool burning, non-corrosive and yield a high volume of gas and low solid particulates because attempts to improve existing gas generating compositions have been unsuccessful for various reasons. For example, while the addition of certain modifiers has lowered the flame temperature and increased gas production, these same modifiers have contributed to the production of undesirable corrosive products. In turn, other modifiers utilized in the past, while not producing corrosive materials, have not succeeded in lowering the flame temperature significantly or of increasing gas evolution.

The usual gas generator composition, known in gas generator technology as the "propellant", is comprised of ammonium nitrate oxidizer with rubbery binders or in pressed charges. Various chemicals, such as guanidine nitrate, oxamide and melamine, are used in the propellant to aid ignition, give smooth burning, modify burning rates and give lower flame temperatures.

Ammonium nitrate is the most commonly used oxidizer since it is exceptionally effective per unit weight and yields a non-toxic and non-corrosive exhaust at low flame temperatures. Further, it contributes to burning rates lower than those of other oxidizers. Ammonium nitrate is cheap, readily available and safe to handle. The main objection to ammonium nitrate is that it undergoes certain phase changes during temperature variations causing cracks and voids if any associated binder is not sufficiently strong and flexible to hold the composition together.

Ammonium nitrate compositions are hygroscopic and difficult to ignite, particularly if small amounts of moisture have been absorbed. Since said compositions do not sustain combustion at low pressures, various combustion catalysts are added to promote ignition and low pressure combustion as well as to achieve smooth, stable burning. Gas generator compositions used for air bags should contain no metallic additives, such as ammonium dichromate, copper chromite, etc., since they all produce solids in the exhaust gases.

Gas generator compositions are usually manufactured by a pressing or by an extruding and compression molding technique. The solid particles are formed and the composition is broken up into bits ("granulated") with appropriate granulator-type equipment.

After granulation, the composition is loaded into molds of the required shapes and pressed to about 7000 psi (4921 $kg/cm^2$) . With certain types of binder, the molds are heated to about 180° F. (82° C.) until the composition is cured or vulcanized. The grain is then potted into the gas generator cases. The molds, mills and extrusion equipment are costly; the lengthy process time further increases the cost of manufacture. It is especially difficult to produce large grains by this technique.

The art is replete with instances of compositions containing a guanidine-type compound together with an oxidizer, such as ammonium nitrate. For example, in U.S. Pat. No. 3,031,347, guanidine nitrate and ammonium nitrate are listed together at column 2, as well as in Examples 3 and 5. However, compared with the present invention, the composition disclosed in the patent is not a eutectic solution-forming mixture. Likewise, see U.S. Pat. No. 3,739,574, col. 2, in the Table. On the other hand, U.S. Pat. No. 3,845,970, at column 3, discloses a list of solid compositions for generating gas in a shock absorption system. Among the components of the various compositions are ammonium nitrate and aminoguanidine nitrate. The two materials are not disclosed in admixture and, obviously, are not in a eutectic composition.

Similarly, U.S. Pat. No. 3,954,528, discloses new solid composite gas generating compositions. Among the ingredients mentioned are ammonium nitrate and triaminoguanidine nitrate. See Examples 2 through 5. However, neither the specific components of the aminoguanidine nitrate compositions at hand, nor any eutectic compositions, are disclosed therein.

In U.S. Pat. No. 4,111,728, the inventor discloses ammonium nitrate with small amounts of guanidine nitrate. See column 2 and the table at columns 3–4. However, the compositions do not include aminoguanidine nitrate and do not characterize any composition as forming a eutectic solution.

U.S. Pat. No. 5,125,684 also discloses propellant compositions containing dry aminoguanidine nitrate and an oxidizer salt containing a nitrate anion. However, the disclosure is deficient with respect to the present invention since it fails to disclose the specific combination of components of the present invention and does not mention eutectics.

Also, U.S. Pat. No. 5,336,439 concerns salt compositions and concentrates used in explosive emulsions. As disclosed at columns 37 and 38, ammonium nitrate is one of the ingredients for forming the patentee's composition, while at column 20, line 51, aminoguanidine is indicated as also being an appropriate component. Nevertheless, like the other disclosures mentioned, the patent fails to disclose a specific composition including the same nitrates as are disclosed herein and clearly does not teach a eutectic composition containing said components.

Many patents mention $KClO_4$ in lists of possible oxidizers with various fuels and possibly binders, catalysts, etc. Note for example, U.S. Pat. Nos. 5,035,757 and 5,197,758. Moreover, the perchlorate may be used as an aqueous solution, as in U.S. Pat. No. 4,543,136. Also, eutectics have been employed, but not with the particular materials of the present invention. See U.S. Pat. No. 5,411,615 disclosing a eutectic of AN/GN/ethylene diamine dinitrate (EDDN) plus ammonium perchlorate (AP). Of course, a drawback to the use of AP is the necessity to balance the oxidizer with a metal, such as Na or K, to avoid the production of HCl or other toxic products. See U.S. Pat. No. 4,948,439.

A composition comprising about 8 to about 40 weight percent of aminoguanidinium nitrate with about 8 to about 30 weight percent of an alkali metal perchlorate as oxidizer is shown and claimed in U.S. Pat. No. 3,909,324. However, the composition is used with an agent for chemical warfare, smoke dyes, plant regulants or incapacitating agents. The patentee does not use the perchlorate as a stabilizer, does not include ammonium nitrate, does not employ a eutectic solution and is not concerned with generating gas for inflating air bags in automobiles.

Finally, U.S. Pat. No. 5,482,579 does concern compositions for use with air bags. The patent discloses and contains claims reciting a cellulose acetate and potassium perchlorate as oxidizer. In Table 3 of the patent, guanidine nitrate is disclosed in a composition with the cellulose acetate and potassium perchlorate. The patent does not suggest the additional inclusion of ammonium nitrate, the use of a eutectic or the recited ratios of components comprising the instant invention.

BACKGROUND OF THE INVENTION

The invention in our co-pending application Ser. No. 08/508,350 involves eutectic mixtures of ammonium nitrate and guanidine nitrate or aminoguanidine nitrate with a potassium nitrate stabilizer, as well as a method of generating a particulate-free, non-toxic, odorless and colorless gas for various purposes, such as to inflate an air bag in an automotive vehicle. In the generation of a particulate-free, non-toxic, odorless and colorless gas, an enclosed pressure chamber having an exit port is provided; a solid eutectic solution comprising ammonium nitrate and either aminoguanidine nitrate or guanidine nitrate is disposed within said chamber; means are then provided for igniting said eutectic solution in response to a sudden deceleration being detected by a detection device in the pressure chamber, whereby gas is instantly generated and conducted through the exit port of the pressure chamber to accomplish a desired function, such as inflating an automotive vehicle air bag.

SUMMARY OF THE INVENTION

Figure 1:
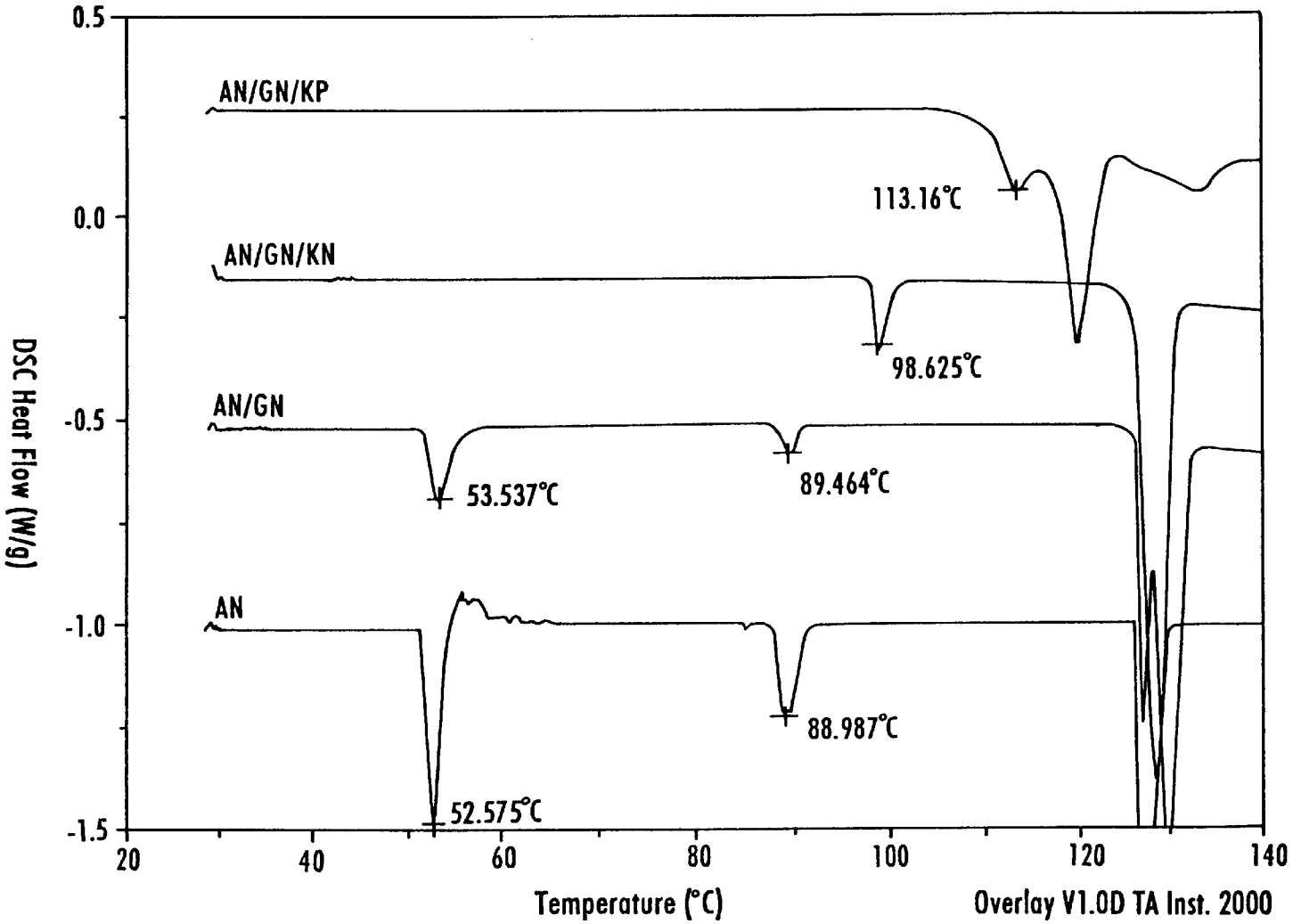
FIG. 1 is a graph of the heat flow generated by each of AN/GN, AN/GN/KN and AN/GN/KP.

Eutectic mixtures of ammonium nitrate and aminoguanidine nitrate or guanidine nitrate, it has been found, eliminate pellet cracking and substantially reduce ammonium nitrate phase change due to temperature cycling. Moreover, the addition up to about 10% potassium nitrate to the noted eutectic stabilizes the ammonium nitrate, totally eliminates the ammonium nitrate phase change and maintains the freedom from cracking of the pressed pellet upon temperature cycling.

Although our earlier invention provides desirable improved results, it has now been discovered that certain other benefits are unexpectedly obtained in the eutectic solution-forming mixture of AN and AGN or GN by employing $KClO_4$, instead of KN, as the stabilizer for such composition. Notwithstanding the generation of some corrosive exhaust gases by oxidizers such as ammonium perchlorate, the presence of $KClO_4$ preserves the composition's stability at 107° C. for about 400 hours and cycle from −40° to +107° for 200 cycles.

The ballistic properties of the air bag propellant composition are significantly improved. While the pressure exponent (n) is lowered from greater than 1.0 to a range of about 0.39 to about 0.78, the burn rate ($r_b$) is increased at about 2000 psia from about 0.39 inches/second to a value in the range of about 0.46 to about 0.67 inches/second.

DESCRIPTION OF THE PREFERRED EMBODIMENT

To achieve the advantages of employing ammonium nitrate, e.g., low cost, availability and safety, while avoiding its drawbacks, e.g., cracks and voids in the pressed pellet when subjected to temperature cycling, it is proposed to mix the ammonium nitrate oxidizer with aminoguanidine nitrate or guanidine nitrate and then form a eutectic solution which avoids some of the problems previously encountered and discussed above. Thus, the provision of the ammonium nitrate/aminoguanidine nitrate or the AN/GN as a eutectic in the form of a pressed pellet provides a generator to produce a particulate-free, non-toxic, odorless, and colorless gas for inflating an air bag, but without the tendency of the pellet to crack and with reduced phase change of the AN due to temperature cycling. Also, to some degree, the hygroscopicity of the mixture is reduced. By the addition of stabilizing amounts of potassium perchlorate, such as up to about 13% by weight, freedom from cracking of the pressed pellet upon temperature cycling is still maintained and the phase change of the AN is completely eliminated.

When the formulation composed of 35.1% GN+47.4% AN+12.6% KP+5.0% PVA, by weight, is prepared by dissolving all the ingredients in water and mixing down to dryness, a low-melting eutectic is formed; melting point= 119.7° C. The crumb was granulated and compacted into tablets, 0.5" diameter X 0.0701" thick, having a burning rate of 0.67 in/sec @ 2000 psi, with an unexpectedly low burning rate exponent of 0.39.

Earlier work showed that the eutectic formulation stabilized with potassium nitrate (KN) instead of KP, composed of 30% GN+60% AN+5% KN+5% PVA and prepared as above, had a burning rate of only 0.39 in/sec @ 2000 psi, with a very high exponent of 0.96. Thus, stabilizing AN with KP instead of KN not only greatly increased burning rate but had the additional unexpected advantage of greatly decreasing the pressure exponent of burning rate.

When 24.5 gm of the GN/AN/KP/PVA tablets were burned at 8000 psi in a gas generator in a 60-L tank, the tank pressure rose to 47.9 psi at 51.5 ms. The effluent was odorless, colorless, and essentially smokeless.

In addition, it has been discovered that the same eutectic employed to generate the gases may also be used as the igniter in the inflator device. By so utilizing the same eutectic for igniting the propellant, the inventors are able to eradicate the smoke that would otherwise be present in the exhaust. For the igniter load, the eutectic is provided as a powder, granulate, monolithic composite or any other form that may conveniently be disposed in the generator.

In some cases, small amounts (up to about 5% by weight) of polyvinyl alcohol (PVA), as binder, are employed in the foregoing compositions.

THE DRAWINGS

FIG. 1 is a graph of the heat flow generated by each of the compositions AN/GN, AN/GN/Kn, AN/GN/KP and AN alone. This graph demonstrates the effectiveness of the present propellant system, wherein heat flow as measured by a differential scanning calorimiter is shown for four formulations: (1) pure AN; (2) a 50/50 eutectic mixture of AN and GN; (3) a eutectic mixture of 49.125AN/49.125GN/1.75KN, and (4) a eutectic mixture of 47.4AN/35GN/12.6KP/5PVA. These DSC traces show the following:

(1) the low-temperature AN transitions at 52.575° C. in pure AN and 53.537° C. in the 50/50 AN/GN eutectic disappear in the AN/GN/KN and the AN/GN/KP/PVA eutectics, and (2) the intermediate transitions at 88.987° C. in pure AN and 89.464° C. in the 50/50 AN/GN eutectic increase with potassium content to 98.625° C. at 1.75% KN (0.68% K) and to 113.16° C. at 12.6% KP (3.6% K).

Secondly, a number of eutectic mixtures were prepared by dissolving all the ingredients in water and mixing down to dryness. The crumb was granulated and compacted into cylinders measuring approximately 0.5" diameter X 0.5" thick. They were then subjected to 200 cycles in the temperature range −40°/+107° C. and measurements of diameter and compressive strength. Results are summarized in Table 1, shown below:

TABLE 1

EFFECT OF PVA ON THE TEMPERATURE CYCLING OF AN/GN/KP EUTECTIC

| COMP | COMPOSITION, WT % | | | | | DIAMETER, | | |
|---|---|---|---|---|---|---|---|---|
| ID | AN | GN | KP | PVA | STATE | IN | STRENGTH | NOTES |
| 76 | 44 | 44 | 12 | 0 | INITIAL | 0.523 | 5816 | |
| | | | | | FINAL | 0.542 | 5199 | |
| | | | | | % CHANGE | +3.6 | −10.6 | FAIL |
| 88 | 47.4 | 35.0 | 12.6 | 5.0 | INITIAL | 0.521 | 7001 | |
| | | | | | FINAL | 0.531 | 6572 | |
| | | | | | % CHANGE | +1.9 | −6.1 | PASS |
| 110 | 55 | 31 | 9 | 5 | INITIAL | 0.521 | 5612 | |
| | | | | | FINAL | 0.528 | 6675 | |
| | | | | | % CHANGE | +1.3 | +18.9 | PASS, 168 CYCLES |
| 99 | 59 | 30 | 6 | 5 | INITIAL | 0.521 | 5430 | |
| | | | | | FINAL | 0.551 | 6368 | |
| | | | | | % CHANGE | +5.8 | +17.3. | FAIL, @ 50 CYCLES |

The dimensional change during cycling is a primary variable. Great changes are coupled with total loss of strength, and from past experience, changes in excess of 2% are deemed failures. From this perspective, although the effect of PVA on compressive strength is variable, its effect on dimensional change is dramatic. Comparison of the first two formulations, 76 with no PVA and 88 with 5% PVA, shows the latter suffered only about half the dimensional change during cycling, and in fact survived while the former failed. The effect of KP content on dimensional change is shown in the last three entries in the table, formulations 88, 110, and 99 with 12.6, 9 and 6% KP respectively. At a level of 6% KP, the formulation failed cycling, even though it contained 5% PVA. At 9% KP, it passed. This indicates that about 5% PVA and about 9% KP are needed in eutectics with AN and GN to enable temperature cycling between −40° to +107° C. The formulations 88 and 110 are within the scope of the instant invention.

Figure 2:
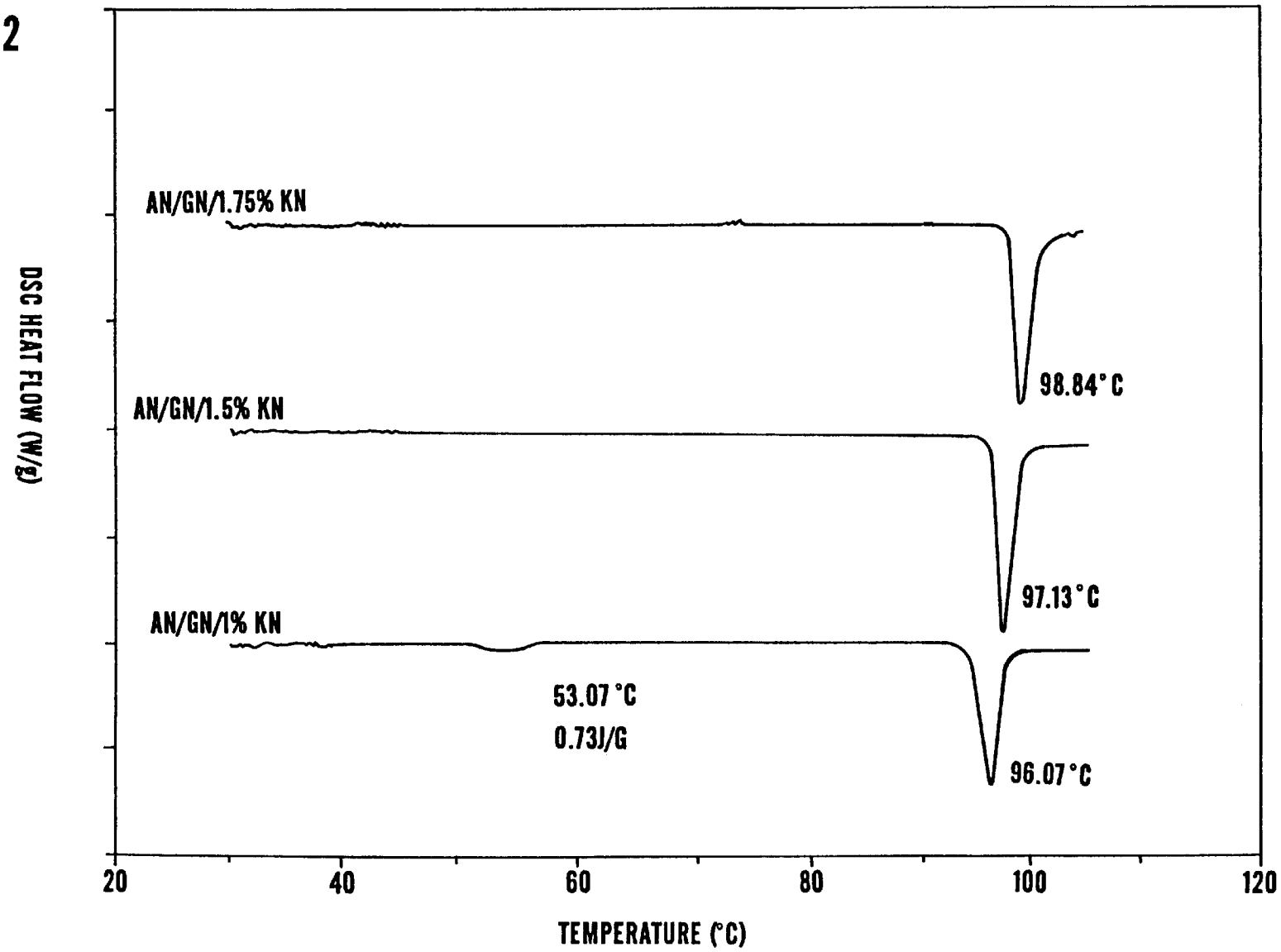
FIG. 2 is a diagram of a conventional passenger side inflator.

FIG. 2 depicts a conventional hybrid apparatus for use in the generation of gas to inflate an automotive vehicle air bag. As is readily seen from the drawing, the outlet ports are provided at the extreme right of the device.

In said figure, the initiator (1) ignites in response to a sensor (not shown) that senses rapid deceleration indicative of a collision. The initiator gives off hot gas that ignites the ignition charge (2) which causes the main generant charge (8) to combust, mix with the argon gas, generating the inflation gas mixture (3). When the pressure in said gas mixture increases to a certain point, the seal disc (6) ruptures permitting the gas mixture to exit the manifold (4) through the outlet ports (5) and inflate an air bag. The generant container (9) holds the main generant charge (8). All the charges and the inflation gas mixture are enclosed in the pressure tank (7).

The most preferred formulations based upon present testing, are those of comparison 110 and 88. However, it is contemplated that other formulations containing the disclosed eutectic composition, together with the $KClO_4$ stabilizer and optionally a binder, such as polyvinyl alcohol binder, will also prove to be of equivalent efficacy. Likewise, corresponding results are expected from compositions in which guanidine nitrate is replaced with a counterpart amount of aminoguanidine nitrate.

Figure 3:
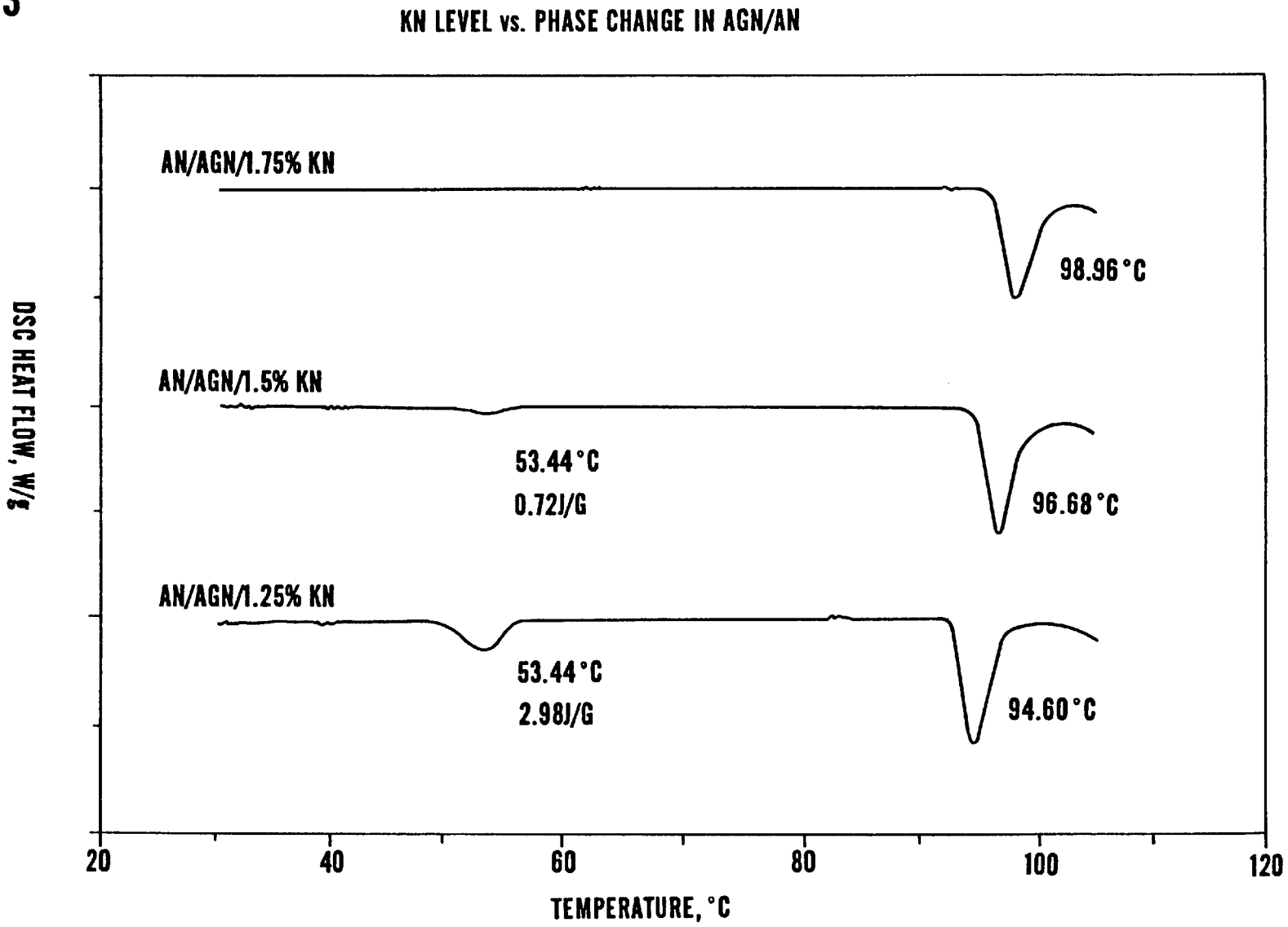
FIG. 3 is a diagram of a conventional pyrotechnic generator.

FIG. 3 is a drawing of the pyrotechnic generator of the instant invention. Since no part of the inflator is reserved for storage capacity, the device is smaller than its counterpart hybrid inflator. In this figure, a cartridge (21) holds a generant (22), which may be a eutectic solid solution of GN/AN with at least 5 by weight KN and at least 3% by weight PVA formulated to an oxidizer ratio of about 0.95. At one end of said cartridge (21) is an initiator (23) that will combust in response to a signal from a sensor (not shown) which generates said signal as a result of a change in conditions, e.g., an excessive increase in temperature or a sudden deceleration of a vehicle (indicative of a crash), in which the inflator is installed. The initiator (23) is kept in place by an initiator retainer (24). An O-ring (25) serves as a gasket to render the inflator essentially gas tight in the end where the initiator (23) is located.

The end of the inflator opposite from that containing the initiator (23) holds a screen (27) upon which any particulates in the produced gas are retained, a spring (29) to maintain dimensional stability of the generant bed, and a burst disc (28), which is ruptured when the gas pressure exceeds a predetermined value, permitting the gas to escape from the cartridge (21) through exit ports (not shown) situated like those in FIG. 2. To ensure that the expelled gas is not released in an unduly strong stream, a diffuser (30) is affixed to the discharge end of the inflator.

Only the preferred embodiment of the invention and a few examples of its versatility are shown and described in the present disclosure. It is to be understood that the invention is capable of use in various other combinations and environments and is capable of changes or modifications within the scope of the inventive concept as expressed herein.

Additional objects and advantages of the present invention will become readily apparent to those skilled in this art from the description. As will be realized, the invention is capable of other and different embodiments, and its several details are capable of modifications in various obvious respects, all without departing from the invention. Accordingly, the drawings and description are to be regarded as illustrative in nature, and not as restrictive.

We claim:

1. A composition for generating a low particulate substantially non-toxic, odorless and colorless gas comprising: a eutectic solution-forming mixture of ammonium nitrate, either aminoguanidine nitrate or guanidine nitrate and a stabilizing amount of potassium perchlorate and PVA.

2. The composition of claim 1 wherein the potassium perchlorate is present in an amount up to about 13% by weight.

3. The composition of claim 2 wherein the potassium perchlorate is present in the range of about 8 to about 13% by weight.

4. The composition of claim 3 in the form of a pressed pellet which is resistant to cracking when subjected to temperature cycling.

5. The composition of claim 1 consisting essentially of about 35% by weight GN, about 47.4% by weight AN, about 12.6% by weight $KClO_4$ and about 5% by weight PVA.

6. The composition of claim 1 consisting essentially of about 31% by weight GN, about 55% by weight AN about 9% by weight $KClO_4$ and about 5% by weight PVA.

7. A method of generating a stable low particulate non-toxic, odorless and colorless gas comprising the steps:

a) providing an enclosed pressure chamber having exit ports, b) disposing within said chamber, a gas-generative solid propellant eutectic solution comprising ammonium nitrate, either aminoguanidine nitrate or guanidine nitrate, and potassium perchlorate, and c) providing means for igniting said eutectic solution upon detection by a sensor of the pressure chamber being subjected to a sudden deceleration, whereby gas is substantially instantly generated and conducted through the exit ports of said pressure chamber.

8. The method of claim 7, carried out in an automotive vehicle equipped with at least one air bag, wherein the generated gas, conducted through the exit ports, thereafter enters said air bag, which it instantly inflates.

9. The method of claim 8, wherein the eutectic solution includes an amount of potassium perchlorate up to about 13% by weight.

10. The method of claim 9 wherein the eutectic solution is present in the form of a pressed pellet which is resistant to cracking when subjected to temperature cycling.

11. The method of claim 8 wherein the means for igniting the eutectic propellant solution comprises an effective amount of a eutectic solution of essentially the same components as the propellant solution.

12. The composition of claim 1 wherein the mixture includes about 1% by weight to about 5% by weight PVA.

13. The method of claim 7 wherein the eutectic solution includes about 1% by weight to about 5% by weight PVA.

14. In a method of essentially instantly generating a gas wherein a propellant composition is disposed within a chamber in a gas generator and means are provided for igniting said composition in response to the detection of a sudden deceleration, the improvement wherein the propellant composition comprises a eutectic solution containing ammonium nitrate, at least one of aminoguanidine nitrate and guanidine nitrate, and a minor effective stabilizing amount of each of polyvinyl alcohol and either potassium nitrate or potassium perchlorate.

15. The method of claim 14, carried out in an automotive vehicle equipped with at least one air bag, wherein the generated gas, conducted through the exit ports, thereafter enters said air bag, which it essentially instantly inflates.

16. The method of claim 15, wherein the eutectic solution includes an amount of potassium perchlorate up to about 13% by weight .

17. The method of claim 15 wherein the eutectic solution is present in the form of a pressed pellet which is resistant to cracking when subjected to temperature cycling.

18. The method of claim 15 wherein the means for igniting the eutectic propellant solution comprises an effective amount of a eutectic solution of essentially the same components as the propellant composition.

19. The method of claim 14 wherein the eutectic solution contains about 5i by weight PVA.

* * * * *